US010946656B2

(12) United States Patent
Murayama et al.

(10) Patent No.: US 10,946,656 B2
(45) Date of Patent: Mar. 16, 2021

(54) LIQUID EJECTION HEAD AND LIQUID EJECTION APPARATUS

(71) Applicant: SEIKO EPSON CORPORATION, Tokyo (JP)

(72) Inventors: Toshiro Murayama, Suwa (JP); Yuma Fukuzawa, Matsumoto (JP); Shunya Fukuda, Azumino (JP); Kazuaki Uchida, Suwa (JP); Shunsuke Watanabe, Matsumoto (JP); Noriaki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/453,102

(22) Filed: Jun. 26, 2019

(65) Prior Publication Data

US 2020/0001602 A1 Jan. 2, 2020

(30) Foreign Application Priority Data

Jun. 29, 2018 (JP) ..... JP2018-124185

(51) Int. Cl.
*B41J 2/14* (2006.01)
*B41J 2/165* (2006.01)

(52) U.S. Cl.
CPC ..... *B41J 2/1433* (2013.01); *B41J 2/14201* (2013.01); *B41J 2002/14483* (2013.01)

(58) Field of Classification Search
CPC ..... B41J 2/1433; B41J 2/14201; B41J 2/145; B41J 2/165
See application file for complete search history.

(56) References Cited

U.S. PATENT DOCUMENTS

2012/0176450 A1* 7/2012 Akahane ..... B41J 2/14233 347/47
2017/0253034 A1 9/2017 Tsukamoto
2017/0282556 A1* 10/2017 Hozumi ..... B41J 2/14161

FOREIGN PATENT DOCUMENTS

JP 2012-143948 A 8/2012
WO 2018-116846 6/2018

OTHER PUBLICATIONS

European Search Report for EP 19182773 dated Oct. 31, 2019.

* cited by examiner

*Primary Examiner* — Jason S Uhlenhake
(74) *Attorney, Agent, or Firm* — Workman Nydegger

(57) ABSTRACT

A liquid ejection head includes a flow path substrate, a first plate having a nozzle, and a second plate. A flow path substrate includes a first communication path which passes through a flow path substrate in a thickness direction and has an opening on each of a first plate side and a second plate side, and a second communication path communicating with an opening on a first plate side of a first communication path at a first plate side and extending on the second plate side. A pressure chamber communicating with a first communication path and a first flow path through which a liquid flows into a pressure chamber are formed by a part of a second plate and a part of a flow path substrate.

18 Claims, 6 Drawing Sheets

LIQUID EJECTION HEAD AND LIQUID EJECTION APPARATUS

The present application is based on, and claims priority from JP Application Serial Number 2018-124185, filed Jun. 29, 2018, the disclosure of which is hereby incorporated by reference herein in its entirety.

BACKGROUND

1. Technical Field

The present disclosure relates to a liquid ejection head and a liquid ejection apparatus.

2. Related Art

A liquid ejection head of a liquid ejection apparatus ejecting a liquid from a nozzle that a flow path is formed in which a common flow path serving as a liquid storage chamber is coupled to individual flow paths corresponding to the number of nozzles. For example, JP-A-2012-143948 discloses a liquid ejection head in which a flow path is configured by a nozzle plate having a nozzle, a flow path substrate having a flow path therein, and a pressure chamber substrate having a pressure chamber.

In the related art, a wall surface of a flow path in a flow path substrate may be configured by a nozzle plate. In such a case, if the wall surfaces of a plurality of flow paths are configured by the nozzle plate, the nozzle plate may be enlarged. When the wall surfaces of the plurality of flow paths are formed by a member other than the nozzle plate, for example, another flow path substrate is to be stacked, which causes a problem that the number of components is increased.

SUMMARY

According to an aspect of the present disclosure, a liquid ejection head for ejecting a liquid is provided. The liquid ejection head includes a flow path substrate through which a liquid flows, and a first plate and a second plate attached to locations facing each other and interposing the flow path substrate therebetween. The first plate includes a nozzle, and the second plate includes a pressure chamber for generating a fluid pressure fluctuation. The nozzle and the pressure chamber communicate with each other through a first communication path which is a passing-through portion provided in the flow path substrate. The first plate and the second plate close an opening of the passing-through portion provided in the flow path substrate separately from the passing-through portion configuring the first communication path, thereby, configuring a second communication path communicating with the first communication path.

DESCRIPTION OF EXEMPLARY EMBODIMENTS

A. First Embodiment

Figure 1:
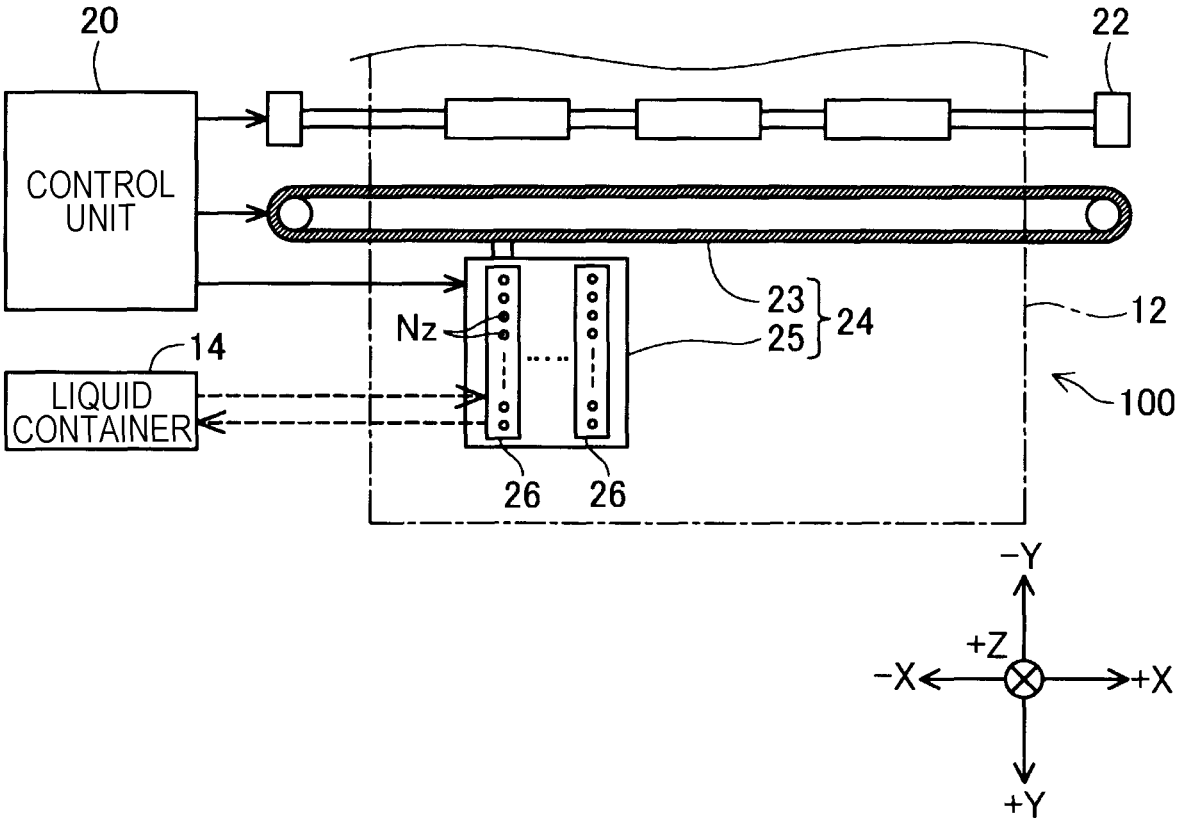
FIG. 1 is an explanatory diagram schematically illustrating a configuration of a liquid ejection apparatus according to a first embodiment.

FIG. 1 is an explanatory diagram schematically illustrating a configuration of a liquid ejection apparatus 100 according to a first embodiment of the present disclosure. The liquid ejection apparatus 100 is an ink jet type printing apparatus that ejects droplets of ink, which is an example of a liquid, onto a medium 12 for printing. In addition to printing paper, a printing target of any material such as a resin film or cloth can be adopted as the medium 12. In each drawing after FIG. 1, among the X direction, the Y direction, and the Z direction orthogonal to one another, a main scan direction along a transport direction of the liquid ejection head 26 is set to the X direction, a sub-scan direction which is a sending direction of the medium 12 is set to the Y direction, and an ink ejection direction is set to the Z direction. The ink ejection direction may be parallel to a vertical direction or may be a direction intersecting the vertical direction. In the following description, the main scan direction is appropriately referred to as a printing direction for the sake of convenient description. When a direction is specified, a positive direction is set to "+", a negative direction is set to "−", and a positive sign and a negative sign are used together for a direction notation. The liquid ejection apparatus 100 may be a so-called line printer in which the sending direction (sub-scan direction) of the medium and a transport direction (main scan direction) of the liquid ejection head 26 coincide with each other.

The liquid ejection apparatus 100 includes a liquid container 14, a transport mechanism 22 that sends out the medium 12, a control unit 20, a head movement mechanism 24, and a liquid ejection head 26. The liquid container 14 individually stores a plurality of types of ink ejected from the liquid ejection head 26. The liquid container 14 includes a flow mechanism (not illustrated) configured by a pump. The liquid ejection apparatus 100 moves the ink through a flow path in the liquid ejection head 26 using the flow mechanism, ejects ink from a nozzle Nz, circulates the ink, and stores the ink again in the liquid container 14. A bag-like ink pack formed of a flexible film, an ink tank capable of replenishing ink, or the like can be used as the liquid container 14. The nozzle Nz is a circular through-hole through which the ink is ejected.

The control unit 20 includes a processing circuit such as a central processing unit (CPU) or a field programmable gate array (FPGA) and a memory circuit such as a semiconductor memory and collectively controls the transport mechanism 22, the head movement mechanism 24, and the liquid ejection head 26. The transport mechanism 22 operates under the control of the control unit 20 and transports the medium 12 in the Y direction.

The head movement mechanism 24 includes a transport belt 23 wound around a printing range of the medium 12 in the X direction, and a carriage 25 that contains the liquid ejection head 26 and fixes the liquid ejection head to the transport belt 23. The head movement mechanism 24 operates under the control of the control unit 20 and causes the liquid ejection head 26 to reciprocate together with the carriage 25 in the main scan direction. When the carriage 25 reciprocates, the carriage 25 is guided by a guide rail (not illustrated). A head configuration in which the liquid container 14 is mounted on the carriage 25 together with the liquid ejection head 26 may be adopted.

The liquid ejection head 26 is a stacking body in which head configuration members are stacked in the Z direction. As illustrated in FIG. 1, the liquid ejection head 26 includes nozzle rows in which rows of nozzles Nz are arranged in the sub-scan direction. The liquid ejection head 26 is prepared for each color of ink stored in the liquid container 14 and ejects ink supplied from the liquid container 14 from a plurality of nozzles Nz toward the medium 12 under the control of the control unit 20. A desirable image or the like is printed on the medium 12 by ejecting ink from the nozzles Nz during reciprocation of the liquid ejection head 26. Arrows denoted by broken lines in FIG. 1 schematically represent movement of ink between the liquid container 14 and the liquid ejection head 26. The liquid ejection head 26 according to the present embodiment circulates the ink using a flow mechanism not illustrated between the liquid ejection head and the liquid container 14.

Figure 2:
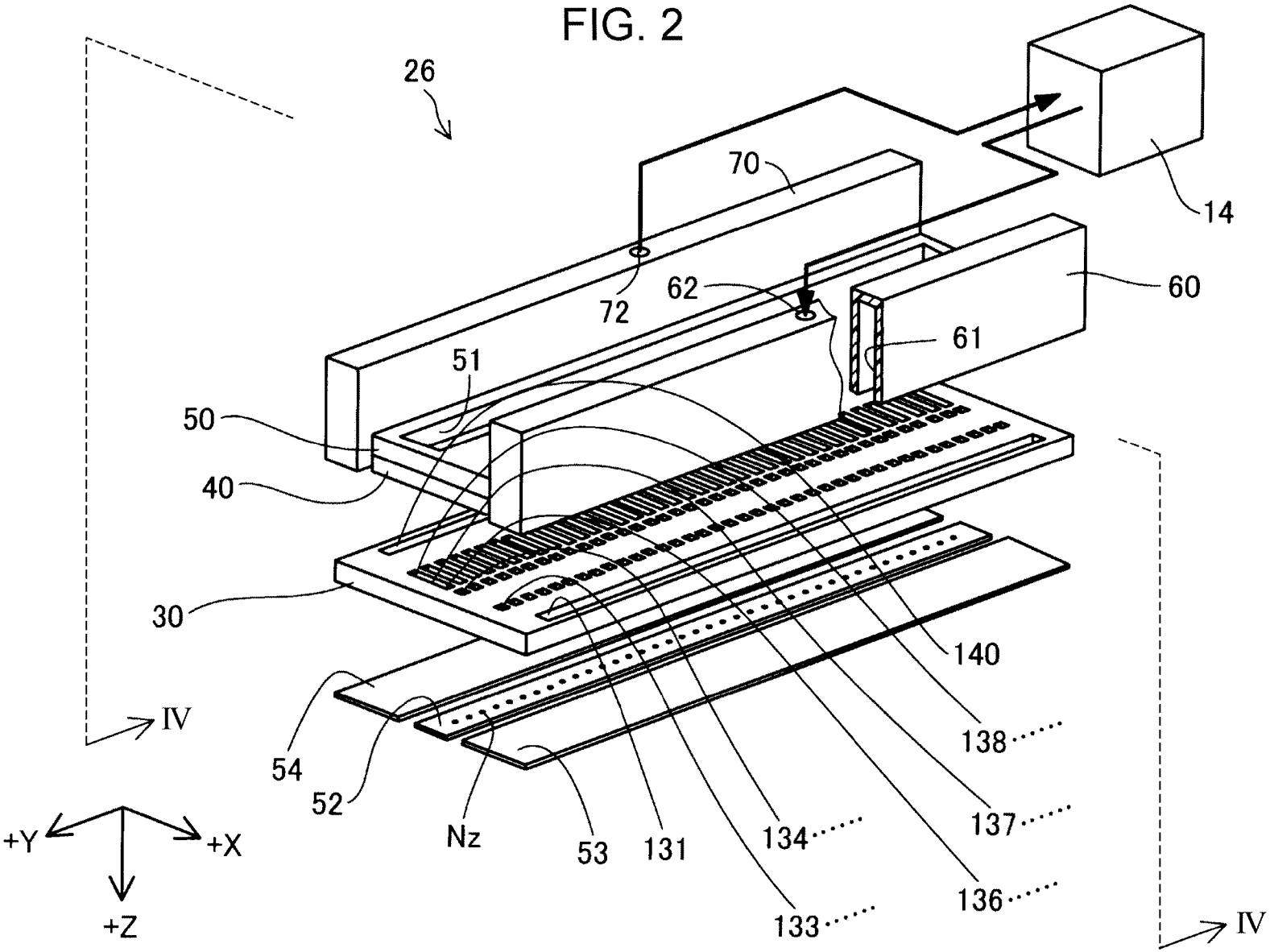
FIG. 2 is an exploded perspective view from an upper side of a main head configuration member of the liquid ejection head.
Figure 3:
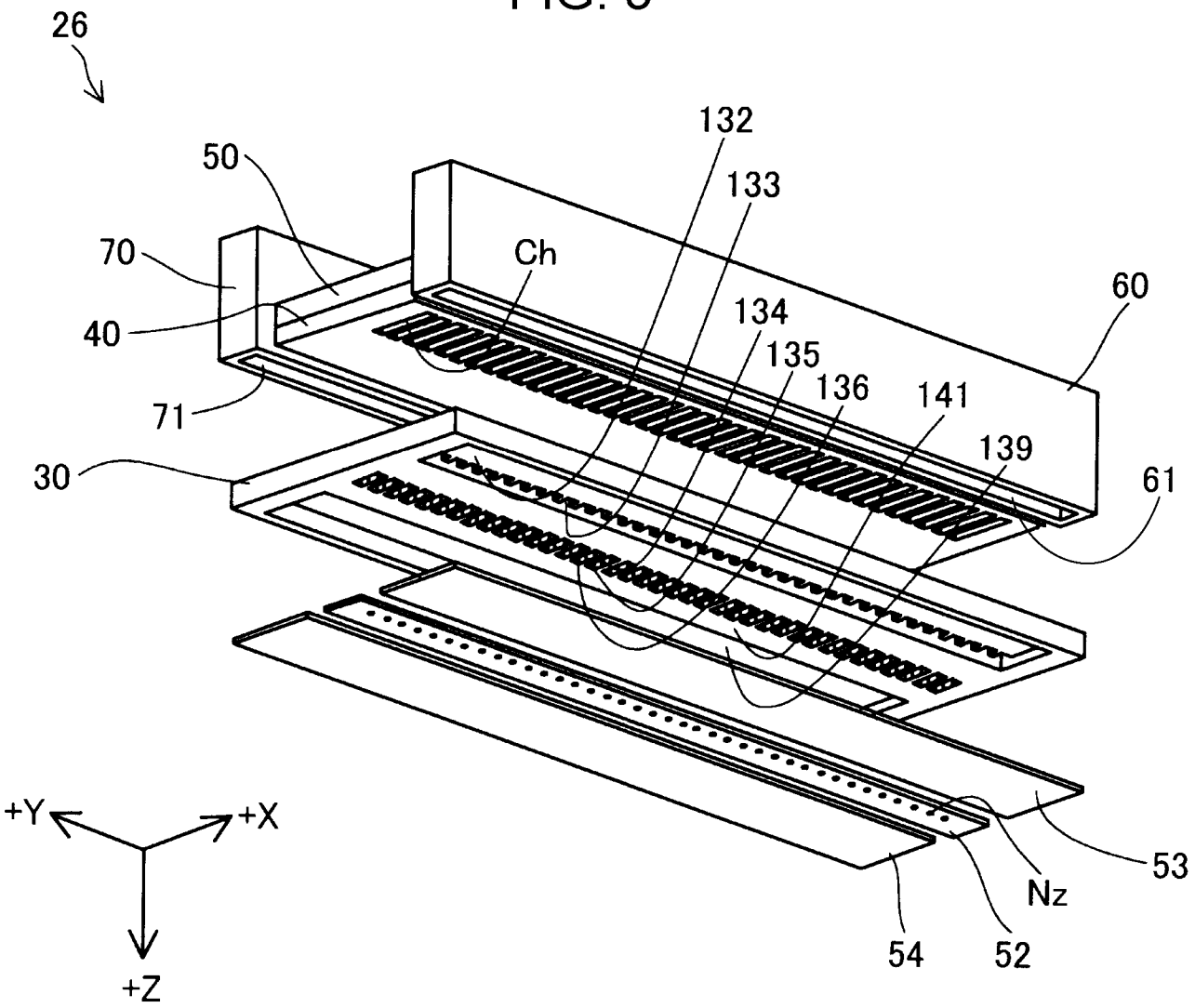
FIG. 3 is an exploded perspective view from a lower side of the main head configuration member of the liquid ejection head.
Figure 4:
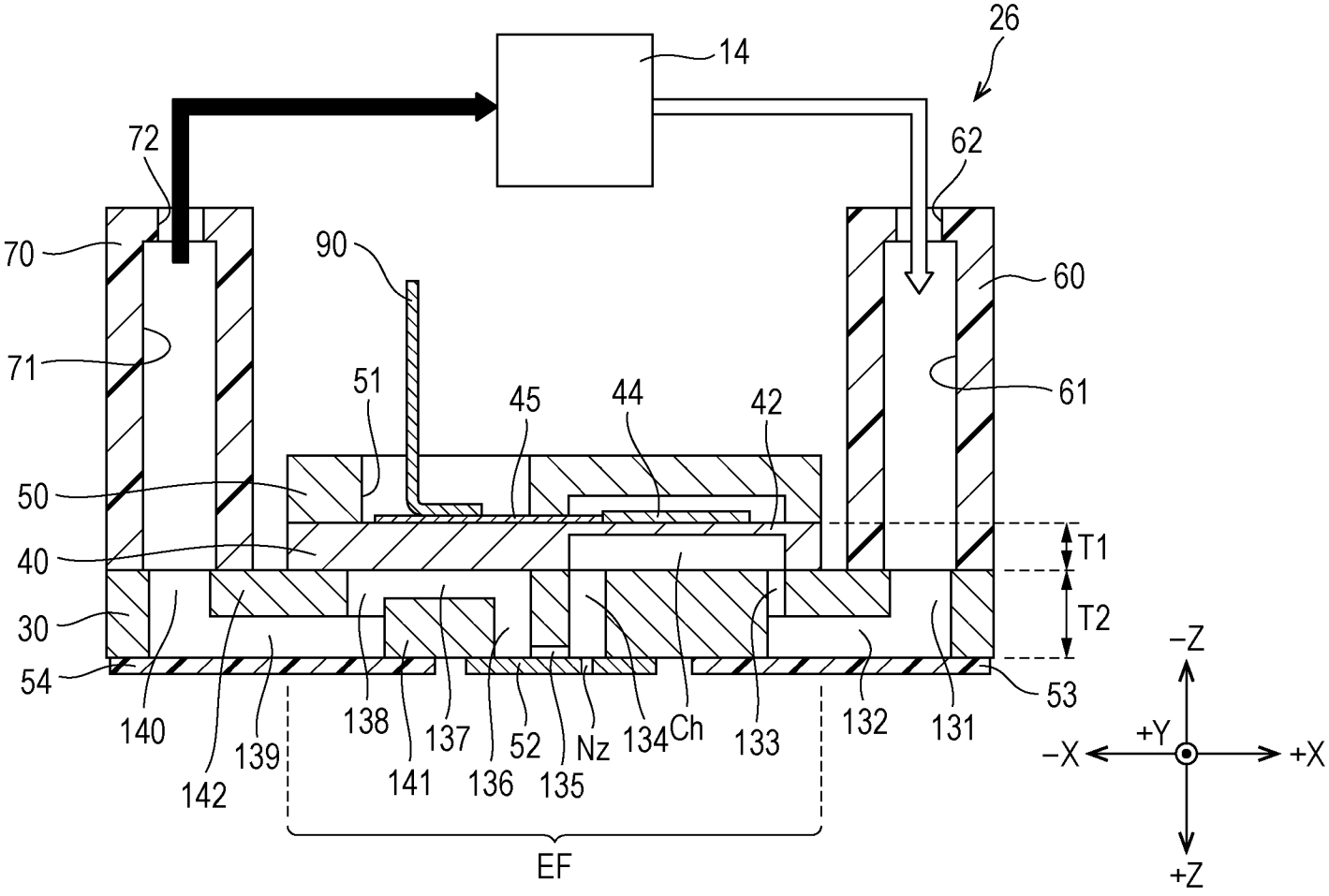
FIG. 4 is a cross-sectional view of the liquid ejection head taken along the line IV-IV of FIG. 2.

FIG. 2 is an exploded perspective view from an upper side of a main head configuration member of the liquid ejection head 26. FIG. 3 is an exploded perspective view from a lower side of the main head configuration member of the liquid ejection head 26. FIG. 4 is a cross-sectional view of the liquid ejection head 26 taken along line IV-IV in FIG. 2. A thickness of each the illustrated configuration members does not illustrate an actual thickness. Hereinafter, a flow path of the ink in the liquid ejection head 26 according to the present embodiment will be described with reference to FIGS. 2 to 4.

The liquid ejection head 26 includes a flow path substrate 30 in which a flow path of the ink is formed, a nozzle plate 52 which is a first plate, a pressure chamber substrate 40 which is a second plate, a protection member 50 for protecting a piezoelectric element 44, a first case member 60 for supplying ink, a second case member 70 for recovering the ink, a first vibration absorber 53, and a second vibration absorber 54. The first case member 60 and the second case member 70 may be formed integrally or may be configured separately. The first vibration absorber 53 and the second vibration absorber 54 may be formed integrally or may be configured separately.

The flow path substrate 30 is a planar plate body elongated in the Y direction rather than in the X direction in a plan view from the Z direction. When an ink ejection direction side of the liquid ejection head 26 is set as a lower side, the first case member 60 and the second case member 70 are mounted on an upper surface of the flow path substrate 30, and the pressure chamber substrate 40 is coupled between the two case members. A nozzle plate 52 having the nozzles, the first vibration absorber 53, the second vibration absorber 54 are coupled at locations facing the pressure chamber substrate 40 on a lower surface of the flow path substrate 30 interposed therebetween. In the present embodiment, the flow path substrate 30 is a single crystal substrate formed of silicon. Various flow paths which will be described below are formed inside the flow path substrate 30 by applying a processing technology used for semiconductor manufacturing technology such as dry etching or wet etching. The flow path substrate 30 may be formed by three-dimensional modeling using a 3D printer, laser modeling or the like.

Various flow paths of the liquid ejection head 26 are formed by coupling through holes or concave grooves provided inside the flow path substrate 30 to the respective plate bodies. More specifically, by closing the concave groove on a lower surface of the plate with the nozzle plate 52, the first vibration absorber 53, or the second vibration absorber 54, a flow path is formed between the nozzle plate 52, the first vibration absorber 53, and the second vibration absorber 54. Hereinafter, configurations of the respective portions will be described in association with formation of the flow path from an upstream side which is an ink supply side to a downstream side which is a discharge side.

The first case member 60 is a plate body elongated in the Y direction rather than in the X direction in a plan view from Z direction, and includes an ink receiving chamber 61 therein. The ink receiving chamber 61 is an elongated space in which a concave groove of which Z direction side is opened extends in the Y direction. The ink receiving chamber 61 configures a part of an ink storage chamber for receiving the ink supplied from the liquid container 14 via the ink introduction hole 62. The first case member 60 is formed by injection molding of a resin material. As described above, in the liquid ejection head 26 according to the present embodiment, an upstream side of the ink circulation flow path is set as the ink receiving chamber 61, but the ink receiving chamber 61 may be set as the downstream side with the flow path reversed.

An ink flow path is formed inside the flow path substrate 30. More specifically, the flow path substrate 30 includes an ink inflow chamber 131, a first common flow path 132, a first flow path 133, a first communication path 134, an individual supply path 135, a second communication path 136, a second flow path 137, a third flow path 138, a second common flow path 139, and an ink discharge chamber 140 in order from the upstream side.

As illustrated in FIG. 2, the ink inflow chamber 131 is a through hole having an elongated opening in the Y direction. As illustrated in FIG. 4, the first case member 60 is assembled to the flow path substrate 30 such that the ink inflow chamber 131 overlaps the ink receiving chamber 61. Thereby, the ink inflow chamber 131 is coupled to the ink receiving chamber 61.

As illustrated in FIGS. 3 and 4, the first common flow path 132 is an elongated concave groove formed on a lower surface side of the flow path substrate 30. The first common flow path 132 is coupled to the ink inflow chamber 131 to form one common liquid chamber. The first common flow path 132 is formed as a flow path by closing an opening portion on the lower surface side of a plate of the flow path substrate 30 by using the first vibration absorber 53. That is, a part of an inner wall of the first common flow path 132 is configured by the first vibration absorber 53.

The first vibration absorber 53 absorbs pressure fluctuations in the ink inflow chamber 131 and the first common flow path 132. The first vibration absorber 53 may be configured by a flexible planar film, rubber, a thin film substrate, or a compliance substrate including the flexible planar film, the rubber, and the thin film substrate. The first vibration absorber 53 may have elasticity. Thereby, it possible to increase compliance of the common flow path configured by the ink inflow chamber 131 and the first common flow path 132 and to suppress occurrence of crosstalk when ink is ejected.

As illustrated in FIGS. 2 and 4, the first flow path 133 is a through-hole passing through the flow path substrate 30 in the Z direction and reaches the first common flow path 132. The number of the first flow paths 133 is equal to the number of the nozzles Nz for one first common flow path 132. Thereby, the first flow path 133 becomes a supply hole for branching from the first common flow path 132 to each individual flow path. The first flow path 133 is coupled to one end of a pressure chamber Ch provided for each nozzle Nz.

As illustrated in FIGS. 2 and 4, the pressure chamber Ch is a concave groove formed on a lower surface of the pressure chamber substrate 40. The pressure chamber Ch is a flow path surrounded by the groove of the pressure chamber substrate 40 and an upper surface of the flow path substrate 30 and is formed by coupling the pressure chamber substrate 40 to the upper surface of the flow path substrate 30. As described above, the pressure chamber Ch and the first flow path 133 are formed by a part of the pressure chamber substrate 40 and a part of the flow path substrate 30 on the first communication path 134 side which will be described, among the pressure chamber substrate 40 and the flow path substrate 30.

As illustrated in FIGS. 2 and 4, the first communication path 134 is a through-hole that passes through the flow path substrate 30 in a thickness direction and has an opening on the pressure chamber substrate 40 side and the nozzle plate 52 side of the flow path substrate 30. The first communication path 134 is provided by the number of nozzles Nz. In the present embodiment, the opening on the lower surface side of the flow path substrate 30 among the openings of the first communication paths 134 is closed by the nozzle plate 52. The nozzle Nz is located at the opening of the first communication path 134 on the lower surface side of the flow path substrate 30. The opening on the upper surface side of the flow path substrate 30 among the openings of the first communication path 134 is closed by the pressure chamber substrate 40 and is coupled to the other end side of the pressure chamber Ch. Thereby, the pressure chamber Ch and the nozzle Nz communicate with each other through the first communication path 134. In the present embodiment, among the pressure chamber substrate 40 and the flow path substrate 30, the pressure chamber Ch and the first flow path 133 through which the ink flows into the pressure chamber Ch are formed by a part of the pressure chamber substrate 40 and a part of the flow path substrate 30 on the first communication path 134 side which a supply side.

The nozzle plate 52 is a plate-shaped member coupled to the lower surface side of the flow path substrate 30. The first communication path 134, the individual supply path 135 and the second communication path 136 which will be described below are closed on the lower surface side of the plate of the flow path substrate 30. In the present embodiment, the nozzle plate 52 is a single crystal substrate formed of silicon. In the same manner as the flow path substrate 30, the nozzle plate 52 is formed with nozzles Nz in a row shape as illustrated in FIG. 2 by applying a processing technology. In the present embodiment, an ejection direction of the ink by the nozzle Nz is the Z direction as described above, and a plane direction of the nozzle plate 52 is parallel to the XY plane perpendicular to the ejection direction.

As illustrated in FIGS. 3 and 4, the individual supply path 135 is a concave groove formed on a lower surface side of the flow path substrate 30 and is provided by the number of nozzles Nz. In the present embodiment, the individual supply path 135 is coupled to the first communication path 134 on the lower surface side of the flow path substrate 30, that is, on the nozzle plate 52 side. The individual supply path 135 is closed by the nozzle plate 52 and is formed as an individual flow path extending in a surface direction of the nozzle plate 52. That is, a part of the inner wall of the individual supply path 135 is configured by the nozzle plate 52. The individual supply path 135 functions as an ejection hole through which the ink flows on a downstream side which is after the nozzle Nz, that is, on a discharge side. The individual supply path 135 couples an opening on the nozzle plate 52 side of the first communication path 134 to an end on the nozzle plate 52 side of the second communication path 136.

The second communication path 136 is a flow path coupled to the individual supply path 135 and configures a part of an individual flow path on the discharge side. The second communication path 136 is provided by the same number as the number of the nozzles Nz. As illustrated in FIGS. 2 and 4, in the present embodiment, the second communication path 136 is a through-hole that passes through the flow path substrate 30 in a thickness direction and has an opening on each of the pressure chamber substrate 40 side of the flow path substrate 30 and the nozzle plate 52.

The second flow path 137 is a flow path coupled to the second communication path 136 and is provided by the same number as the number of nozzles Nz. As illustrated in FIGS. 2 and 4, the second flow path 137 is a concave groove formed on an upper surface of the plate of the flow path substrate 30 and configures a part of an individual flow path on the discharge side. In the present embodiment, one end of the second flow path 137 is coupled to the second communication path 136 on the upper surface side of the flow path substrate 30, that is, on the pressure chamber substrate 40 side. The second flow path 137 is closed by the pressure chamber substrate 40 and is formed as a flow path extending in the surface direction of the pressure chamber substrate 40. That is, a part of an inner wall of the individual supply path 135 is configured by the pressure chamber substrate 40. The second flow path 137 is formed to communicate with the third flow path 138.

In FIG. 4, a thickness T1 of the pressure chamber substrate 40 and a thickness T2 of the flow path substrate 30 are schematically illustrated. The "thickness" refers to a thickness of each plate in a direction in which the flow path substrate 30 and the pressure chamber substrate 40 are stacked. In the present embodiment, the thickness T2 of the flow path substrate 30 is greater than the thickness T1 of the pressure chamber substrate 40. A concave groove of the second flow path 137 can be deeper by increasing the thickness of the flow path substrate 30. Thereby, a cross-sectional area of the second flow path 137 is increased. A flow path resistance of the second flow path 137 is reduced, and flow of the ink in the flow path substrate 30 is promoted.

As illustrated in FIGS. 2 and 4, the third flow path 138 is a through-hole passing through the flow path substrate 30 and reaching the second common flow path 139. The third flow path 138 is in communication with the second flow path 137 by being coupled to the other end side of the second flow path 137 and extends from the pressure chamber substrate 40 side to the nozzle plate 52 side to communicate with the second common flow path 139. The third flow path 138 is an individual flow path provided by the number of nozzles Nz. Each of the third flow paths 138 is coupled to the second common flow path 139 which is one common liquid chamber. Thereby, the third flow path 138 functions as a supply hole from an individual flow path to the common liquid chamber on the discharge side, that is, an outlet on the discharge side of the individual flow path.

As such, the individual flow path according to the present embodiment is configured with the first flow path 133, the pressure chamber Ch, the second communication path 134, the second communication path 136, the second flow path 137, and the third flow path 138. One liquid ejection portion 80 is configured by coupling one nozzle Nz to the individual flow path. The liquid ejection head 26 according to the present embodiment includes the liquid ejection portions 80 having the same number as the number of nozzles Nz.

As illustrated in FIGS. 3 and 4, the second common flow path 139 is one elongated concave groove formed on the lower surface side of the flow path substrate 30. The second common flow path 139 is coupled to the ink discharge chamber 140 to configure one common liquid chamber. The second common flow path 139 closes an opening portion on the lower surface side of the plate of the flow path substrate 30 using the second vibration absorber 54 to be formed as a flow path. That is, a part of an inner wall of the second common flow path 139 is configured by the second vibration absorber 54. The second vibration absorber 54 is a compliance substrate formed of the same material as the first vibration absorber 53. Thereby, it is possible to increase compliance of the common flow path on the discharge side configured by the ink discharge chamber 140 and the first common flow path 132, and to suppress occurrence of crosstalk when ink is ejected.

As illustrated in FIG. 2, the ink discharge chamber 140 is a through-hole having an elongated opening in the Y direction. As illustrated in FIG. 4, the ink discharge chamber 140 is configured by assembling the second case member 70 and the flow path substrate 30 so as to overlap an ink containing chamber 71. Thereby, the ink discharge chamber 140 is coupled to the ink containing chamber 71 in the second case member 70.

The second case member 70 is a plate body elongated in the Y direction and includes an ink containing chamber 71 therein. The ink storage chamber 71 is an elongated space in which a concave groove whose Z direction is opened extends in the Y direction. The ink containing chamber 71 receives the ink discharged from the ink discharge chamber 140 and configures a part of the ink storage chamber on the discharge side. The ink in the ink containing chamber 71 is refluxed to the liquid container 14 via the ink discharge hole 72, as indicated by a black arrow in FIG. 4. In the present embodiment, the second case member 70 is formed by injection molding using the same resin material as the first case member 60, but the second case member 70 and the first case member 60 may be formed of materials different from each other. The ink reflux from the second case member 70 is realized by a flow mechanism not illustrated. Mounting of the second case member 70 to the flow path substrate 30 is made liquid-tight by using an appropriate adhesive.

The pressure chamber substrate 40 is a plate body that forms the above-described pressure chamber Ch for each nozzle Nz. In the same manner as the flow path substrate 30, the pressure chamber substrate 40 can be formed through application of the above-described semiconductor manufacturing technology to a single crystal substrate formed of silicon. The pressure chamber substrate 40 includes a vibration portion 42 in addition to the pressure chamber Ch.

The vibration portion 42 is a wall surface of the pressure chamber Ch formed in a thin plate shape so as to be capable of vibrating elastically. The vibration portion 42 is provided on a surface of the pressure chamber substrate 40 on a side opposite to the flow path substrate 30 side and configures a part of the pressure chamber substrate 40 facing the pressure chamber Ch, that is, a wall surface on a ceiling side of the pressure chamber Ch. A piezoelectric element 44 is provided for each pressure chamber Ch on a surface of the vibration portion 42 on a side opposite to the pressure chamber Ch side. Each piezoelectric element 44 is a passive element that individually corresponds to the nozzle Nz and deforms upon receiving a drive signal. The piezoelectric element 44 is disposed in the vibration portion 42 in association with the arrangement of the nozzles Nz and functions as a pressure generation portion. Vibration of the piezoelectric element 44 transmits a vibration portion 42 to cause a pressure change in the ink filled in the pressure chamber Ch. The pressure change reaches the nozzle Nz via the first communication path 134, and thereby, the ink is ejected from the nozzle Nz. The piezoelectric element 44 includes two electrode layers provided on an upper surface of the pressure chamber substrate 40 and a piezoelectric layer interposed between the two electrode layers in the Z direction. The pressure generation portion may be a heating element that generates heat to cause a pressure change in the ink filled in the pressure chamber Ch, may be an electrostatic element or a MEMS element.

The protection member 50 is a silicon single crystal substrate stacked on the pressure chamber substrate 40. A lead electrode 45 electrically coupled to the piezoelectric element 44 for each pressure chamber Ch may be provided (on an interface) between the pressure chamber substrate 40 and the protection member 50. As illustrated in FIG. 2, the protection member 50 is a plate body elongated in the Y direction rather than in the X direction in a plan view from the Z direction, forms a concave space on the upper surface side of the vibration portion 42, and covers the vibration portion 42 together with the piezoelectric element 44. The protection member 50 may be formed by injection molding of an appropriate resin material. The protection member 50 has a rectangular through-hole 51 elongated in the Y direction for installation of the wiring substrate 90 in electrical contact with the lead electrode 45. The lead electrode 45 is electrically coupled to the electrode layer of the piezoelectric element 44. The lead electrode 45 may be an electrode drawn from the electrode layer of the piezoelectric element 44 in an in-plane direction of the XY plane.

The wiring substrate 90 is a flexible substrate on which a drive circuit configured by a drive IC is mounted. The wiring substrate 90 supplies a signal from the drive circuit from the control unit 20 to each of the piezoelectric elements 44 via the lead electrode 45.

As such, in the liquid ejection head 26 according to the present embodiment, the ink supplied from the liquid container 14 by a flow mechanism not illustrated flows into the ink inflow chamber 131 and the first common flow path 132 of the flow path substrate 30 via the ink receiving chamber 61 of the first case member 60 and fills the ink inflow chamber 131 and the first common flow path 132 which are shared supply paths. The ink filled in the shared supply path is extruded into the individual flow path for each nozzle Nz by the continuously supplied ink and is supplied to the liquid ejection portion 80. More specifically, the extruded ink is branched to be supplied to each of the first flow paths 133 which are inlets of the individual flow paths and is supplied to each of the pressure chambers Ch. In the pressure chamber Ch, the ink is ejected from the nozzle Nz in response to vibration of the piezoelectric element 44 driven and controlled by the control unit 20. Supply of the ink from the liquid container 14 is continued even under a printing situation in which the ink is being ejected from the nozzle Nz and even in a situation without ink ejection from the nozzle Nz.

In a situation in which the supply of the ink to the pressure chamber Ch is continuing, the ink not ejected from the nozzle Nz flows through a flow path on the discharge side which is subsequent to the nozzle Nz. More specifically, the ink flows from the first communication path 134 to the individual supply path 135, passes through the second communication path 136 and the third flow path 138, is extruded into the second common flow path 139 and the discharge chamber 140 which are common liquid chambers, and is sent out to the ink containing chamber 71 of the second case member 70. Thereafter, the ink is refluxed to the liquid container 14.

The first plate mounting seat 141 is a part of the flow path substrate 30 surrounded by the second communication path 136, the second flow path 137, the third flow path 138, and the second common flow path 139 in a cross section of the flow path substrate 30 illustrated in FIG. 4. The first plate mounting seat 141 configures a mounting seat for bonding the flow path substrate 30, the nozzle plate 52, and the second vibration absorber 54 to a wall surface on a lower surface side of the flow path substrate 30.

The second plate mounting seat 142 is a part of the flow path substrate 30 surrounded by the third flow path 138, the second common flow path 139, and the ink discharge chamber 140 in the cross section of the flow path substrate 30 illustrated in FIG. 4. The first plate mounting seat 141 configures a mounting seat for bonding the flow path substrate 30 and the pressure chamber substrate 40 onto the wall surface on the upper surface side of the flow path substrate 30.

Figure 5:
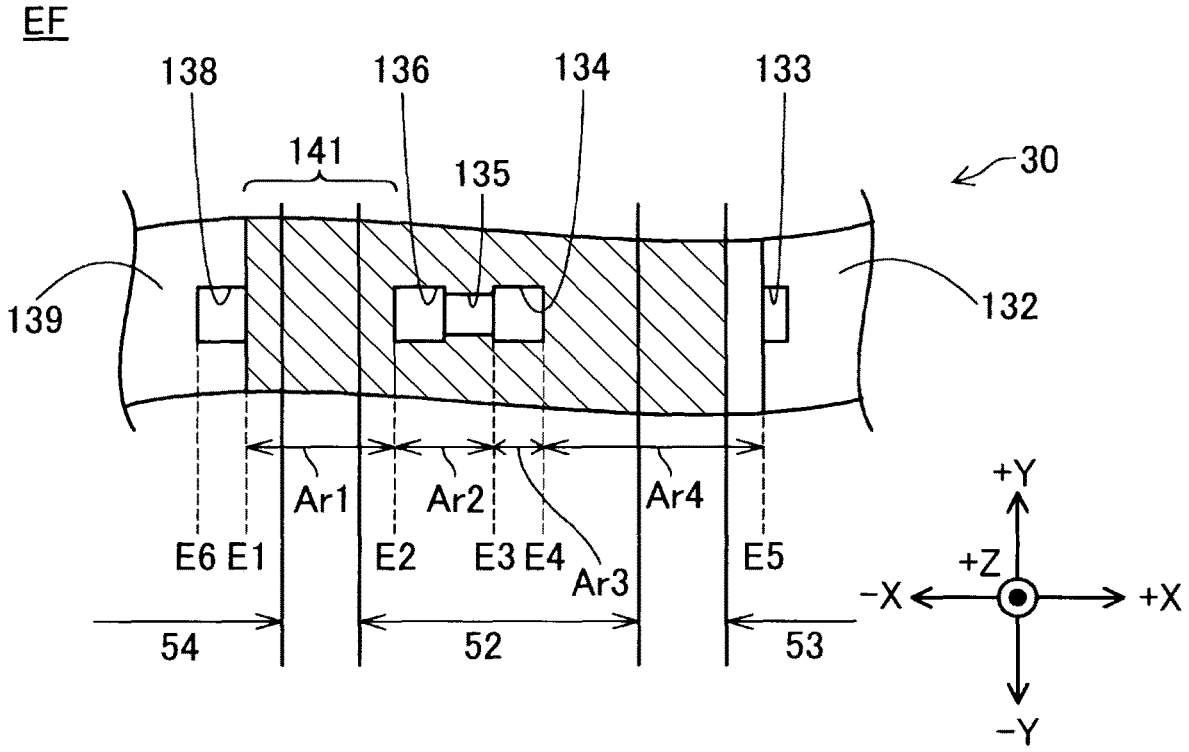
FIG. 5 is an explanatory diagram illustrating a surface on a +Z direction side in a region of the flow path substrate in FIG. 4.

FIG. 5 is an explanatory diagram illustrating a surface on the +Z direction side in a region EF of the flow path substrate 30 of FIG. 4. Hereinafter, a configuration of the first plate mounting seat 141 included in the liquid ejection head 26 according to the present embodiment will be described in detail by using FIG. 5 together with FIG. 4. In order to facilitate understanding of a technology, FIG. 5 schematically illustrates only a location where the nozzle plate 52, the first vibration absorber 53, and the second vibration absorber 54 are arranged and does not illustrate the other things. E1 to E5 denoted by dashed lines in FIG. 5 represent locations of end portions of the respective portions added for the sake of convenient description. The end portion E1 is an end portion on the +X direction side of the second common flow path 139. The end portion E2 is an end portion on the −X direction side of the second communication path 136. The end portion E3 is an end portion on the −X direction side of the first communication path 134. The end portion E4 is an end portion on the +X direction side of the first communication path 134. The end portion E5 is an end portion on the −X direction side of the first common flow path 132. The end portion E6 is an end portion on the −X direction side of the third flow path 138. Ar1 to Ar4 illustrated in FIG. 5 are regions added for the sake of convenient description in the X direction and represent regions interposed between the respective end portions E1 to E5 in the X direction.

The region Ar1 is interposed between the end portion E1 and the end portion E2. The region Ar1 configures the first plate mounting seat 141 for bonding the second vibration absorber 54 and the nozzle plate 52 to the flow path substrate 30. The end portion on the +X direction side of the second vibration absorber 54 affixed to the flow path substrate 30 and the end portion on the −X direction side of the nozzle plate 52 are located at the region Ar1.

The region Ar2 is interposed between the end portion E2 and the end portion E3, and is closed by the nozzle plate 52 affixed to the flow path substrate 30. The region Ar3 is interposed by the end portion E3 and the end portion E4. That is, a width of the region Ar3 in the X direction is equal to a width of the first communication path 134 in the X direction. The region Ar3 is a region which is closed by the nozzle plate 52 and in which the nozzle Nz is disposed.

The region Ar4 is interposed between the end portion E4 and the end portion E5. The region Ar4 is a region where the first vibration absorber 53 and the nozzle plate 52 are bonded to the flow path substrate 30. The end portion on the +X direction side of the nozzle plate 52 and the end portion on the −X direction side of the first vibration absorber 53 affixed to the flow path substrate 30 are located in the region Ar4. As such, in the liquid ejection head 26 according to the present embodiment, the nozzle plate 52 has the nozzle Nz overlapped with the first communication path 134 of the region Ar3, the end portion on the −X direction side is affixed to the region Ar1, and the end portion on the +X direction side is affixed to the region Ar4.

In the present embodiment, the second communication path 136 passes through the flow path substrate 30 in a thickness direction thereof. That is, the second communication path 136 is formed to passes through via the opening on the nozzle plate 52 side of the first communication path 134 and the individual supply path 135 and to extend toward the pressure chamber substrate 40 side. Thereby, the end portion E2 is formed on the flow path substrate 30. As such, in the liquid ejection head 26 according to the present embodiment, the first plate mounting seat 141 for securing a width of the region Ar1 for disposing the end portion on the +X direction side of the second vibration absorber 54 and the end portion on the −X direction side of the nozzle plate 52 is formed by forming the end portion E2. Thereby, the miniaturized nozzle plate 52 can be provided for one flow path substrate 30. Likewise, the third flow path 138 is coupled to the second flow path 137 formed on the upper surface side of the flow path substrate 30 and passes through the flow path substrate 30 in a thickness direction thereof. Thereby, the end portion E6 is formed on the upper surface side of the flow path substrate 30, and the second plate mounting seat 142 is formed. Thus, it is possible to reduce an area of the pressure chamber substrate 40 required to close the second flow path 137 for one flow path substrate 30.

In the liquid ejection head 26 according to the present embodiment, the ink inflow chamber 131 and the first common flow path 132 configuring a shared supply path are closed by the flexible first vibration absorber 53 over a flow path region thereof, and the second common flow path 139 and the ink discharge chamber 140 configuring a shared recovering path are closed by the flexible second vibration absorber 54 over a flow path region thereof. Accordingly, an ink supply pressure applied to the ink filled in the ink inflow chamber 131 and the first common flow path 132 is attenuated by deflection of the first vibration absorber 53. The ink supply pressure applied to the ink filled in the second common flow path 139 and the ink discharge chamber 140 and an ink ejection pressure at the time of ejecting the ink are attenuated by deflection of the second vibration absorber 54. Thereby, according to the liquid ejection head 26 of the present embodiment, it is possible to reduce occurrence of crosstalk which increases amplitudes of a vibration waveform of the pressure chamber and a vibration waveform generated by a flow of liquid.

B. Second Embodiment

Figure 6:
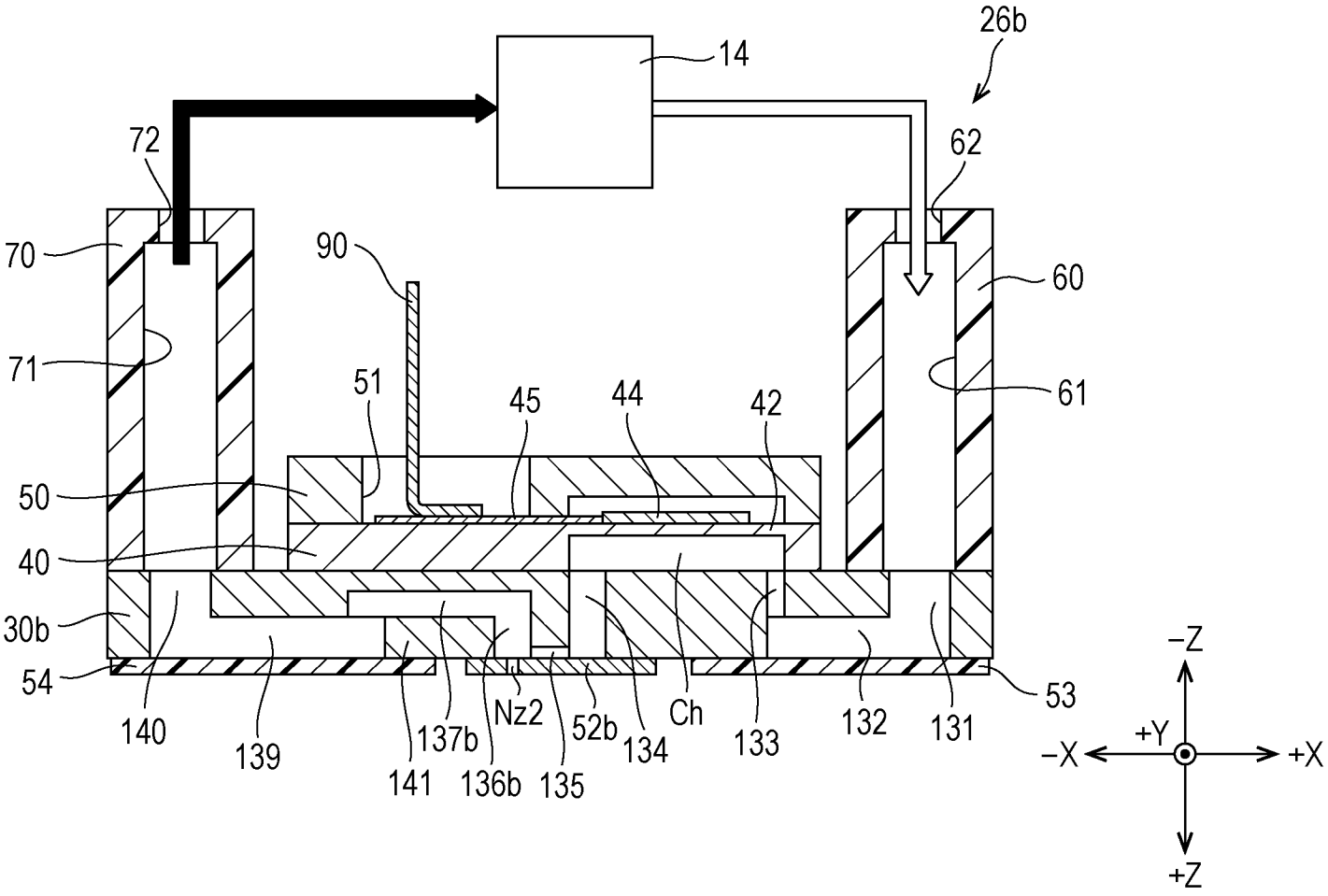
FIG. 6 is a cross-sectional diagram of a liquid ejection head according to a second embodiment.

FIG. 6 is a cross-sectional diagram of a liquid ejection head **26*b* according to a second embodiment. The liquid ejection head 26*b* according to the second embodiment differs from the liquid ejection head according to the first embodiment in that a flow path substrate 30***b* is provided instead of the flow path substrate 30 of the liquid ejection head 26 according to the first embodiment, and the other configuration is the same as the liquid ejection head 26 according to the first embodiment. The flow path substrate 30*b* is different from the flow path substrate 30 according to the first embodiment in that a nozzle plate 52*b* is provided instead of the nozzle plate 52, a second communication path 136*b* is provided instead of the second communication path 136, a second flow path 137*b* is provided instead of the second flow path 137, the third flow path 138 is not provided, and the second plate mounting seat 142 is not provided, and the other configuration is the same as the flow path substrate 30.

In the liquid ejection head 26*b* according to the present embodiment, the nozzle plate 52*b* is provided on a lower surface side of the flow path substrate 30*b*. The nozzle plate 52*b* differs from the nozzle plate 52 according to the first embodiment in that a nozzle Nz2 is provided instead of the nozzle Nz. The nozzle Nz2 is provided at a location corresponding to the second communication path 136*b*. The nozzle Nz2 differs from the nozzle Nz according to the first embodiment in a location where the nozzle Nz2 is disposed, and the other configuration is the same as the configuration of the nozzle Nz according to the first embodiment. The individual supply path 135 couples the first communication path 134 to an opening on the nozzle plate 52*b* side and is formed along the nozzle plate 52*b*. Accordingly, after the ink supplied to the first communication path 134 reaches the nozzle plate 52*b*, the ink is guided along a surface of the nozzle plate 52*b* so as to converge on the individual supply path 135. Thus, a flow velocity of the ink in the individual supply path 135 tends to be faster than a flow velocity of the ink in the first communication path 134. By coupling the nozzle Nz2 to a portion of the second communication path 136*b* which is an extension of the individual supply path 135, the ink can be easily ejected. It is possible to eject ink in which an increased in viscosity is suppressed.

In the present embodiment, the second communication path 136*b* is in common with the second communication path 136 according to the first embodiment in that the second communication path 136*b* is coupled to the individual supply path 135, but is different from the second communication path 136 according to the first embodiment in that the second communication path 136*b* does not pass through the flow path substrate 30*b*. In the present embodiment, the second communication path 136*b* extends in a direction separated from the flow path substrate 30*b* in a thickness direction of the flow path substrate from the nozzle plate 52*b* side coupled to the individual supply path 135, that is, from the nozzle plate 52*b* side to the pressure chamber substrate 40 side, and is coupled to the second flow path 137*b* inside the flow path substrate 30*b*. The second flow path 137*b* is a hollow flow path provided inside the flow path substrate 30*b*. The second flow path 137*b* can be formed by manufacturing the flow path substrate 30*b* using three-dimensional modeling performed by a 3D printer. Thereby, in the same manner as in the liquid ejection head 26 according to the first embodiment, the end E2 can be formed on the flow path substrate 30*b*, and the first plate mounting seat 141 can be obtained. Thus, it is possible to provide the nozzle plate 52*b* miniaturized for one flow path substrate 30*b*.

C. Other Embodiments (C1) In the respective embodiments described above, the individual supply path 135 is closed by the nozzle plate 52 and is formed as an individual flow path extending in a surface direction of the nozzle plate 52. In contrast to this, the individual supply path may not be formed, and an opening on the nozzle plate side of the first communication path and a portion on the nozzle plate side of the second communication path may be directly coupled on the nozzle plate side. According to the liquid ejection head of this embodiment, for example, by omitting the region Ar2 in FIG. 5, the nozzle plate can be further miniaturized.

(C2) In the respective embodiments described above, the individual supply path 135 is a concave groove formed on a lower surface side of the flow path substrate 30. In contrast to this, the individual supply path may be provided in the nozzle plate or may be formed by a part of the nozzle plate and a part of the flow path substrate.

(C3) In the liquid ejection head 26 according to the respective embodiments described above, one common flow path is coupled to a plurality of individual flow paths. In contrast to this, it is not always necessary to provide a plurality of individual flow paths, and one common flow path may be formed for one individual flow path. In addition, it is not always necessary to provide one common flow path, and a plurality of common flow paths may be provided. In addition, all the plurality of individual flow paths may not be coupled to one common flow path, and the plurality of individual flow paths may be divided into several groups and coupled to a plurality of common flow paths corresponding to each group, and the individual flow paths and the common flow paths may be coupled according to various combinations.

(C4) In the liquid ejection head 26 according to the first embodiment described above, the second flow path 137 is formed on an upper surface of the plate of the flow path substrate 30, and in the liquid ejection head 26*b* according to the second embodiment, the second flow path 137*b* is formed inside the flow path substrate 30*b*. In contrast to this, the second flow path may not be formed on a flow path substrate but may be formed on a pressure chamber substrate. The second flow path may be separated from a pressure chamber and may be formed by at least one of a part of the pressure chamber substrate and a part of the flow path substrate.

(C5) In the liquid ejection head 26 according to the first embodiment described above, the first vibration absorber 53 is a flexible planar film formed of a compliance substrate. In contrast to this, a common flow path configured by the ink inflow chamber and the first common flow path may be closed by another material such as a SUS plate without the first vibration absorber, or a wall surface may be configured by a flow path structure of the flow path substrate to close the common flow path.

(C6) In the liquid ejection head 26 according to the first embodiment described above, the second vibration absorber 54 is a flexible planar film formed of a compliance substrate. In contrast to this, a common flow path on a discharge side configured by the ink discharge chamber and the first common flow path may be closed by another material such as a SUS plate without the first vibration absorber or may be closed by a flow path substrate. A first vibration absorber and a second vibration absorber are not necessarily formed of the same material and may be formed of separate materials, and a compliance substrate may be provided in only one of the first vibration absorber and the second vibration absorber.

(C7) In the liquid ejection head 26 according to the respective embodiments described above, ink is supplied from the first flow path 133 and the pressure chamber Ch side to the first communication path 134 coupled to the nozzle Nz. In contrast to this, a supply side and a discharge side may be opposite to the supply and discharge sides of the liquid ejection head 26 according to the respective embodiments described above, as in an aspect in which the ink is supplied from a second flow path side which is a second communication path side. The supply side and the discharge side may be switched appropriately by switching an ink supply direction using a flow mechanism provided in a liquid ejection apparatus. According to the liquid ejection head of this embodiment, by appropriately changing a circulation direction of the ink, flowability of the ink remaining near the nozzle can be improved, and thereby, it is possible to suppress occurrence of abnormality such as an increase in viscosity of the ink. The ink may be supplied from both a first flow path and a pressure chamber side, and a second flow path and a second communication path side. According to the liquid ejection head of this form, it is possible to increase a filling rate of a liquid near a nozzle.

(C8) The liquid ejection head 26 according to the respective embodiments described above includes a common liquid chamber on a supply side in which the first common flow path 132 and the ink inflow chamber 131 are coupled to each other, and a common liquid chamber on a discharge side in which the second common flow path 139 and the ink discharge chamber 140 are coupled to each other. In contrast to this, both the common liquid chamber on the supply side and the common liquid chamber on the discharge side may not be provided together, or only one of the common liquid chambers may be provided. In an aspect in which the common liquid chambers are not included, it is preferable that flow paths of a first case member and a second case member directly communicate with a flow path of a liquid ejection portion.

(C9) In the liquid ejection head 26 according to the respective embodiments described above, a first case member and a second case member are coupled to the flow path substrate 30. In contrast to this, the first case member and the second case member may not be coupled to the flow path substrate. In such an embodiment, an ink receiving chamber and an ink containing chamber are formed of a stacking substrate different from the first case member and the second case member such as a pressure chamber substrate and a protective member, or by separate members.

(C10) In the liquid ejection head 26 according to the respective embodiments described above, the pressure chambers Ch is a concave groove formed on a lower surface of the pressure chamber substrate 40. In contrast to this, the pressure chamber may be provided on a flow path substrate. The pressure chamber may be formed by a part of the pressure chamber substrate and a part of the flow path substrate on a first communication path side of the pressure chamber substrate and the flow path substrate.

D. Other Aspects

The present disclosure is not limited to the above-described embodiment and can be realized in various forms without departing from a gist thereof. For example, the present disclosure can also be realized by the following aspect. Technical features in the above-described embodiment corresponding to technical features in each of the embodiments which will be described below can be replaced or combined appropriately in order to solve a part or all of the problems of the present disclosure or in order to achieve a part or all of the effects of the present disclosure. If the technical feature is not described as essential in the present specification, the technical feature can be removed appropriately.

(1) According to one aspect of the present disclosure, a liquid ejection head for ejecting a liquid is provided. The liquid ejection head includes a flow path substrate through which a liquid flow; and first and second plates attached to locations opposite to each other on both surfaces of the flow path substrate. The first plate includes a nozzle for ejecting a liquid. The flow path substrate includes: a first communication path which passes through the flow path substrate in a thickness direction and which has an opening on each of the first plate side and the second plate side; and a second communication path which communicates with the opening on the first plate side of the first communication path at the first plate side and which extends to the second plate side. A pressure chamber communicating with the first communication path and a first flow path through which the liquid flows into the pressure chamber may be formed by a part of the second plate and a part of the flow path substrate. The second plate may be provided with a pressure generation portion for deforming a part of the second plate facing the pressure chamber. A second flow path that is formed by at least one of a part of the second plate and a part of the flow path substrate and that makes the liquid flow communicates with the second communication path of the flow path substrate. According to a liquid ejection head of the aspect, a first communication path which is a through-hole of a flow path substrate and a second communication path extending from a first plate side to a second plate side are provided. Thus, a mounting seat for mounting a first plate on a flow path substrate, a miniaturized first plate can be provided.

(2) In the liquid ejection head of the above-described aspect, a plurality of sets of liquid ejection portions, each including the first flow path, the pressure chamber, the first communication path, the nozzle, the second communication path, and the second flow path may be provided. According to the liquid ejection head of the aspect, one liquid ejection head includes a plurality of flow paths and nozzles. Accordingly, it is possible to eject ink from a plurality of nozzles, and to increase a resolution per liquid ejection head.

(3) In the liquid ejection head of the above-described aspect, the flow path substrate may include a first common flow path communicating with each of first flow paths of the plurality of liquid ejection portions. The first common flow path may be provided on a side opposite side to the pressure chamber with respect to the first flow path. According to the liquid ejection head of the aspect, one common flow path is coupled to a plurality of individual flow paths. Thereby, it is possible to increase a filling rate of a liquid in each individual flow path.

(4) In the liquid ejection head of the above-described aspect, a vibration absorber for reducing a pressure fluctuation of the liquid in the first common flow path may be disposed in the first common flow path as a part of a wall of the first common flow path. According to a liquid ejection head of the aspect, it is possible to increase inertance in a common flow path, and to suppress occurrence of crosstalk when a liquid is ejected.

(5) In the liquid ejection head of the above-described aspect, the flow path substrate may include a second common flow path communicating with each of the second flow paths of the plurality of sets of the liquid ejection portions. The second common flow path may be provided on a side opposite to the second communication path with respect to the second flow path. According to a liquid ejection head of the aspect, one common flow path is coupled to a plurality of individual flow paths. Thereby, it is possible to increase a filling rate of a liquid in each individual flow path.

(6) In the liquid ejection head of the above-described aspect, in the second common flow path, a vibration absorber for reducing the pressure fluctuation of the liquid in the second common flow path may be disposed as a part of a wall of the second common flow path. According to a liquid ejection head of the aspect, it is possible to increase inertance in a common flow path, and to suppress occurrence of crosstalk when a liquid is ejected.

(7) In the liquid ejection head of the above-described aspect, a case member including a flow path for supplying the liquid to at least one of the first communication path and the second communication path may further included. According to a liquid ejection head of the aspect, a case member including a flow path for supplying a liquid to a common flow path is provided. As compared with an aspect in which flow paths are stacked and extend by a stacking substrate, a flow path can be formed by integral forming, and joint of the flow paths can be reduced. Since a common flow path often has a flow path larger than an individual flow path, a material that is easier to form can be used.

(8) In the liquid ejection head of the above-described aspect, the second flow path may be formed at an interface between the flow path substrate and the second plate and may extend in a surface direction of the second plate. According to a liquid ejection head of the aspect, a second flow path is formed at a location of an interface between a flow path substrate and a second plate. That is, a second flow path is formed on a surface of at least one of a flow path substrate and a second plate. Accordingly, for example, it is possible to form a second flow path by performing external processing of a flow path substrate, and to more easily process than forming a second flow path inside.

(9) In the liquid ejection head of the above-described aspect, the flow path substrate may include a third flow path in communication with the second flow path and extending from the second plate side to the first plate side. According to the liquid ejection head of the aspect, a mounting seat for mounting a second plate on the flow path substrate is formed, and thereby, it is possible to reduce an area of a second plate necessary to close a second flow path.

(10) In the liquid ejection head of the above-described aspect, a thickness of the flow path substrate in a direction in which the flow path substrate and the second plate are stacked may be greater than the thickness of the second plate. The second flow path may be formed by a groove provided in the flow path substrate. According to the liquid ejection head of the aspect, a second flow path can be provided in a flow path substrate thicker than a second plate. Thereby, it is possible to promote a flow of a liquid in a flow path substrate by forming a second flow path having a large cross-sectional area of a flow path in a flow path substrate to reduce a flow path resistance.

(11) In the liquid ejection head of the above-described aspect, the flow path substrate may include an individual supply path coupling an end portion on the first plate side of the second communication path to the opening on the first plate side of the first communication path. The nozzle may be coupled to the individual supply path. According to a liquid ejection head of the aspect, an individual supply path coupling a first communication path and a second communication path to a first plate side is provided, and a nozzle is provided in an individual supply path. Since the individual supply path is formed along a first plate, a liquid supplied to a first communication path is converged along a first plate and guided to an individual supply path. Accordingly, a nozzle can be provided at a portion where a flow velocity of the liquid is higher, and the liquid can be easily ejected from the nozzle. In addition, a liquid in which viscosity is suppressed is easily ejected from a nozzle.

(12) According to another aspect of the present disclosure, a liquid ejection device is provided. The liquid ejection apparatus includes the liquid ejection head according to each embodiment described above; and a flow mechanism for making the liquid pass through the flow path substrate and moving the liquid.

The present disclosure can be realized in various forms other than a liquid ejection head or a liquid ejection apparatus. For example, the present disclosure can be realized by aspects, such as a method of manufacturing the liquid ejection head or the liquid ejection apparatus, a method of controlling the liquid ejection head or the liquid ejection apparatus, a computer program for realizing the control method, a non-transitory storage medium storing the computer program, and the like. The present disclosure is not limited to the liquid ejection apparatus that ejects ink and can also be applied to any liquid ejection apparatus that ejects a liquid other than the ink. For example, the present disclosure can be applied to various liquid ejection apparatuses as follows. The present disclosure can be realized by aspects such as an image recording apparatus such as a facsimile apparatus, a color material ejection apparatus used for manufacturing a color filter for an image display apparatus such as a liquid crystal display, an electrode material ejection apparatus used for electrode formation such as an organic electro luminescence (EL) display and a field emission display (FED), a liquid ejection apparatus of ejection a liquid containing a bioorganic matter used for manufacturing a biochip, a sample ejection apparatus as a precision pipette, a lubricating oil ejection apparatus, a resin liquid ejection apparatus, a liquid ejection apparatus ejecting a lubricating oil into a precision machine such as a watch or a camera at pinpoints, a liquid ejection apparatus ejecting a transparent resin liquid such as an ultraviolet curable resin liquid onto a substrate to form a micro-hemispherical lens (optical lens) or the like used for an optical communication element or the like, a liquid ejection apparatus ejecting an acidic or alkaline etching solution to etch a substrate or the like, a liquid ejection apparatus including a liquid ejection head for ejecting a droplet of any other minute amount, and the like.

What is claimed is:

1. A liquid ejection head for ejecting a liquid comprising:

a flow path substrate through which a liquid flows; and a first plate and a second plate attached to locations facing each other and interposing the flow path substrate therebetween, wherein the first plate includes a nozzle, the second plate includes a pressure chamber for generating a fluid pressure fluctuation, the pressure chamber being extended in an X-direction, the nozzle and the pressure chamber communicate with each other through a first communication path which is a passing-through portion provided in the flow path substrate, the first communication path being extended in a Z-direction that crosses to the X-direction, and the first plate and the second plate close an opening of a second communication path which is a passing-through portion provided in the flow path substrate, the passing-through portion configuring the second communication path so as to be separate from the passing-through portion configuring the first communication path, the second communication path being extended in the Z-direction.

2. The liquid ejection head according to claim 1, wherein a plurality of sets of liquid ejection portions are provided, each including the pressure chamber, the first communication path, the nozzle, and the second communication path.

3. The liquid ejection head according to claim 2, wherein the flow path substrate includes:

a first common flow path commonly communicating with the plurality of sets of the liquid ejection portions, a supply chamber extending in a Y-direction that crosses both the X-direction and the Z-direction and supplying liquid to the first common flow path, a second common flow path commonly communicating with the plurality of sets of the liquid ejection portions, and a discharge chamber extending in the Y-direction and discharging liquid from the second common flow path.

4. The liquid ejection head according to claim 3, wherein a vibration absorber for reducing a pressure fluctuation of the liquid in the first common flow path is disposed as a part of a wall of the first common flow path.

5. The liquid ejection head according to claim 3, wherein the first communication path and the second communication path interpose between the first common flow path and the second common flow path in the X-direction.

6. The liquid ejection head according to claim 5, wherein the first communication path interposes between the second communication path and the first common flow path in the X-direction, and the second communication path interposes between the first communication path and the second common flow path in the X-direction.

7. The liquid ejection head according to claim 6, wherein the first common flow path interposes between the first communication flow path and the supply chamber in the X-direction, and the second common flow path interposes between the second communication flow path and the discharge chamber in the X-direction.

8. The liquid ejection head according to claim 3, wherein a vibration absorber for reducing the pressure fluctuation of the liquid in the second common flow path is disposed as a part of a wall of the second common flow path.

9. The liquid ejection head according to claim 3, further comprising:

a first case member including a flow path for supplying the liquid to the supply chamber.

10. The liquid ejection head according to claim 3, further comprising:

a second case member including a flow path for discharging the liquid from the discharge chamber.

11. The liquid ejection head according to claim 1, further comprising:

a horizontal flow path extending in the X-direction from the passing-through portion of the communication flow path substrate configuring the second communication path.

12. The liquid ejection head according to claim 11, further comprising:

a flow path extending in the Z-direction from the horizontal flow path.

13. The liquid ejection head according to claim 11, wherein the flow path substrate is thicker than a second plate, and the horizontal flow path is formed by a groove provided in the flow path substrate.

14. The liquid ejection head according to claim 1, wherein a groove formed on a surface on the first plate side of the flow path substrate is closed by the first plate, thereby, configuring an individual supply path making the first communication path communicate with the second communication path.

15. A liquid ejection apparatus comprising:

the liquid ejection head according to claim 1; and a flow mechanism for making the liquid pass through the flow path substrate and moving the liquid.

16. The liquid ejection head according to claim 1, wherein the pressure chamber, the first communication path, the nozzle, and the second communication path are located at the same position in a Y-direction that crosses both the X-direction and the Z-direction.

17. The liquid ejection head according to claim 1, wherein the nozzle is connected to a bottom end of the first communication path.

18. The liquid ejection head according to claim 1, wherein the nozzle is connected to a bottom end of the second communication path.

* * * * *